United States Patent [19]

Cook, Jr. et al.

[11] 3,954,579

[45] May 4, 1976

[54] ELECTROLYTIC METHOD FOR THE SIMULTANEOUS MANUFACTURE OF CONCENTRATED AND DILUTE AQUEOUS HYDROXIDE SOLUTIONS

[75] Inventors: Edward Cook, Jr., Lewiston; Alvin T. Emery, Youngstown, both of N.Y.

[73] Assignee: Hooker Chemicals & Plastics Corporation, Niagara Falls, N.Y.

[22] Filed: Nov. 1, 1973

[21] Appl. No.: 411,618

[52] U.S. Cl. ..... 204/98; 204/128

[51] Int. Cl.[2] ..... C25B 1/16; C25B 1/26

[58] Field of Search ..... 204/98, 128, 296, 295, 204/290 F, 291–294, 266

[56] References Cited

UNITED STATES PATENTS

| | | | |
|---|---|---|---|
| 2,967,807 | 1/1961 | Osborne et al. | 204/128 |
| 3,222,267 | 12/1965 | Tirrell et al. | 204/98 |
| 3,282,875 | 11/1966 | Connolly et al. | 260/29.6 |
| 3,496,077 | 2/1970 | Cooper | 204/98 |
| 3,718,551 | 2/1973 | Martinsons | 204/98 |
| 3,773,634 | 3/1972 | Stacey et al. | 204/98 |

OTHER PUBLICATIONS

"Chlorine, Its Manufacture, Properties and Uses," Sconce, Amer. Chem. Soc., 1962, pp. 110–111, 106.

New Product Information From R & D Division–Plastics Dept., E. I. Dupont & Co., "XR Perfluorosulfonic Acid Membranes " 10–1–69, pp. 1–4.

*Primary Examiner*—R. L. Andrews

*Attorney, Agent, or Firm*—Peter F. Casella; Herbert W. Mylius

[57] ABSTRACT

Hydroxides, such as alkali metal hydroxides, e.g., sodium hydroxide, are made in concentrated and dilute aqueous solutions simultaneously by electrolyzing brine in a cell having a plurality of compartments or zones therein, preferably three, wherein anode and cathode compartments are separated by a buffer compartment formed by permselective membranes of a hydrolyzed copolymer of tetrafluoroethylene and a fluorosulfonated perfluorovinyl ether or of a sulfostyrenated perfluorinated ethylene propylene polymer, while adding water to the buffer zone at such a rate as to produce a dilute hydroxide solution therein at the same time that a relatively concentrated hydroxide solution is being made in the cathode compartment, while maintaining a high caustic current efficiency. For example, sodium hydroxide drawn off from the cathode compartment can have a concentration of from 280 to 340 grams per liter while the more dilute caustic obtainable from the buffer compartment may be at 60 to 150 g./l., with the caustic current efficiency being 80% or more. The more concentrated caustic can be further evaporated to 50% caustic and the dilute caustic solution may be used in nearby industrial applications, e.g., pulping operations, production of hypochlorite, manufacture of chlorates and neutralizations of acids, or may be evaporated to increase its concentration.

8 Claims, 1 Drawing Figure

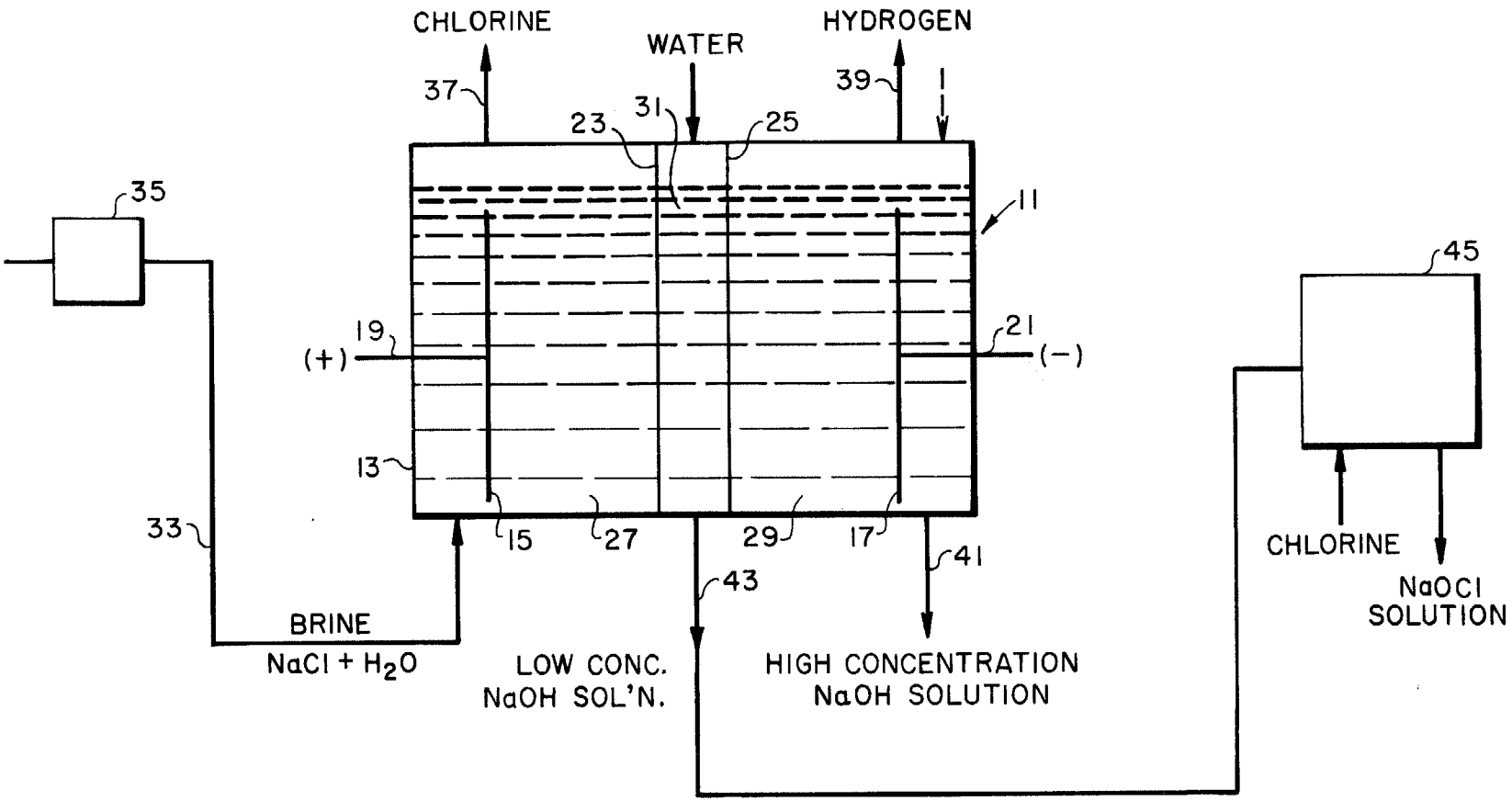
45
NaOCl SOLUTION
CHLORINE
11
21
(−)
HYDROGEN
39
41
HIGH CONCENTRATION NaOH SOLUTION
17
25
29
WATER
31
43
23
27
LOW CONC. NaOH SOL'N.
CHLORINE
37
15
19
(+)
13
BRINE
NaCl + H2O
33
35

ELECTROLYTIC METHOD FOR THE SIMULTANEOUS MANUFACTURE OF CONCENTRATED AND DILUTE AQUEOUS HYDROXIDE SOLUTIONS

This invention relates to the electrolytic manufacture of hydroxide solutions. More specifically, it is of a process for making alkali metal hydroxide in both dilute and more concentrated liquid solution form by the electrolysis of aqueous alkali metal halide solution in an electrolytic cell containing anode, cathode and buffer compartments, with means provided for separating the buffer compartment from the anode and cathode compartments being permselective membranes of a hydrolyzed copolymer of a perfluorinated hydrocarbon and a fluorosulfonated perfluorovinyl ether or a sulfostyrenated perfluorinated ethylene propylene polymer. The cation-permeable membrane permits flow of hydroxyl ion from the catholyte to the buffer zone but does not allow chloride ion to pass through it to mix with the hydroxyl in buffer or catholyte compartments. Thus, chloride-free alkali metal hydroxide is produced in both the cathode and buffer compartments, being at a greater concentration in the catholyte.

Chlorine and caustic are essential and large volume chemicals which are required in all industrial societies. They are commercially produced by electrolysis of aqueous salt solutions. Improved electrolytic methods utilize dimensionally stable anodes, which include noble metals, alloys or oxides or mixtures thereof on valve metals. The concept of employing permselective diaphragms to separate anolyte from catholyte during electrolysis is not a new one and plural compartment electrolytic cells have been suggested which employ one or more of such membranes. Recently, improved membranes have been described which are of a hydrolyzed copolymer of a perfluorinated hydrocarbon and a sulfonated perfluorovinyl ether. In some experiments these membranes have been used between the anolyte and buffer zones of chlorine-caustic cells. Yet, although the electrolysis of aqueous salt solutions is a technologically advanced field of great commercial interest in which much research is performed and although the importance of improving manufacturing methods therein is well recognized, before the present invention there had not been described such an improved process by which high strength, low chloride content caustic solutions could be made at high caustic current efficiencies. Now, such a method has been discovered wherein this is possible when a more dilute caustic solution is also made in the present plural compartment cells, including at least one buffer compartment. The method is especially advantageous when the more dilute caustic solution may be utilized locally, as in nearby pulp mills, hypochlorite generators or for neutralizations of acidic wastes.

In accordance with the present invention a method for electrolytically manufacturing hydroxide in concentrated and dilute aqueous solutions simultaneously comprises electrolyzing an aqueous solution containing halide ions in an electrolytic cell having at least three compartments therein, an anode, a cathode, at least two permselective membranes of a hydrolyzed copolymer of a perfluorinated hydrocarbon and a sulfonated perfluorovinyl ether or a sulfostyrenated perfluorinated ethylene propylene polymer, defining anode- and cathode-side walls of the buffer compartment between it and the anode and cathode compartments, and such walls, with walls thereabout, defining anode and cathode compartments, to produce a dilute hydroxide solution therein at the same time that a more concentrated hydroxide solution is produced in the cathode compartment, and maintaining a high caustic current efficiency.

In preferred embodiments of the invention the permselective membranes are of a hydrolyzed copolymer of tetrafluoroethylene and a fluorosulfonated perfluorovinyl ether of the formula $FSO_2CF_2CF_2OCF(CF_3)CF_2OCF{=}CF_2$, hereafter called PSEPVE, which polymer has an equivalent weight of about 900 to 1,600, at least two such membranes are employed and the membranes are mounted on networks of supporting material such as polytetrafluoroethylene, perfluorinated ethylene propylene polymer, polypropylene, asbestos, titanium, tantalum, niobium or noble metals.

The invention will be more readily understood by reference to the following descriptions of embodiments thereof, taken in conjunction with the drawing of means for effecting the invented processes.

In the drawing:

The FIGURE is a schematic diagram of a three compartment electrolytic cell for producing alkali metal hydroxide solutions by the electrolysis of brine. The cell includes membranes of the described preferred hydrolyzed copolymer separating the anode and cathode compartments from a buffer compartment thereof.

In the FIGURE the points of addition and withdrawal of typical and preferred reactants and products are illustrated. Although the production of sodium hydroxide solutions is illustrated, other halide-forming cations may also be employed and in some instances bromine may be at least partially substituted for chlorine in the halide.

In the FIGURE electrolytic cell 11 includes outer wall 13, anode 15, cathode 17 and conductive means 19 and 21 for connecting the anode and the cathode to sources of positive and negative electrical potentials, respectively. Inside the walled cell permselective membranes 23 and 25 divide the volume into anode or anolyte compartment 27, cathode or catholyte compartment 29 and buffer compartment 31. An aqueous solution of alkali metal halide, preferably acidic, is fed to the anolyte compartment through line 33, from saturator 35. During electrolysis chlorine gas is removed from above the anode compartment through line 37 and hydrogen gas is correspondingly removed from above the cathode compartment through line 39. More concentrated hydroxide solution is withdrawn from cathode compartment 29 through line 41 while the corresponding solution of lower concentration is withdrawn from the buffer compartment through line 43 and is utilized directly for the manufacture of hypochlorite by reaction with chlorine at reactor 45. It may also be used in any other process employing dilute caustic.

The brine charged may be made by dissolving solid sodium chloride in water or in an aqueous medium in saturator 35 and, after withdrawal from the cell, hydroxide solutions may be used as is or may be further processed, as by evaporating the high concentration hydroxide solution to a greater concentration still, e.g., 50% caustic, and employing the more dilute hydroxide solution, preferably locally and directly, but also after further dilution or other modification, in applications for such material in pulping wood chips in pulp mills, generating hypochlorites, manufacturing chlorates, neutralizing acids, peroxide bleaching, making caustic sulfite, regenerating ion-exchange resins or in other applications for which dilute hydroxide solutions are suitable. They may also be evaporated to greater concentrations.

In the process described chloride-free high strength caustic solution can be made at a high caustic current efficiency, e.g., over 80%. Such a process is not feasible with a two compartment cell, even one wherein the present copolymer membranes are employed, due to migration of the hydroxyl ion through the membrane to the anode compartment and generation of oxygen therein, thereby interfering with the chloride electrolysis and diminishing the production of the desired hydroxide. Yet, by following the process of the present invention, utilizing the buffer compartment, migration of hydroxyl ion to the anolyte is diminished and current efficiency increases. It has been found that when 40 to 60%, preferably about 50% of the hydroxide produced is obtained from the buffer compartment a current efficiency over 80% may be maintained whereas when lesser proportions of buffer compartment hydroxide are made efficiencies drop off. Of course, it is also important that the low concentration:high concentration relationship between the buffer and catholyte compartment solutions should be maintained. For example, the catholyte hydroxide taken off should be at a concentration of from 250 to 450 g./l., preferably from 300 to 400 g./l., more preferably from 300 to 350 g./l. and most preferably about 325 g.l., while the concentration of the dilute caustic taken off from the buffer compartment will be from about 60 to 200 g./l., preferably from 80 to 150 g./l. and most preferably about 120 g./l. of sodium hydroxide.

The selective ion-passing effects of cationic membranes have been noted in the past but the membranes of this invention have not been employed in the present processes before and their unexpectedly beneficial effects have not been previously obtained or suggested. Thus, with the use of a comparatively thin membrane, preferably supported as described herein, several years of operation under commercial conditions are obtainable without the need for removal and replacement of the membrane, while it efficiently prevents undesirable migration of chloride ions from the anolyte through the buffer compartment to the catholyte. Simultaneously, it, together with the use of the buffer zone between the anolyte and catholyte zones, prevents hydrogen formed on the cathode side from escaping into the halogen formed on the anode side and prevents hydrogen from infiltrating the chlorine and producing an explosive mixture. In this respect the present membranes are superior to prior art membranes because they are more impervious to the passage of hydrogen, even in comparatively thin films, than are various other known polymeric materials.

Although the preferred embodiments of the invention utilize a pair of the described membranes to form the three compartments of the present cells it will be evident that a greater number of compartments, e.g., 4 to 6, including plural buffer zones, may be employed. Similarly, also, while the compartments will usually be separated by flat membranes and will usually be of substantially rectilinear or parallelepipedal construction, various other shapes, including curves, e.g., ellipsoids, irregular surfaces, e.g., sawtoothed or plurally pointed walls, may also be utilized. In another variation of the invention the buffer zone(s), formed by the plurality of membranes, will be between bipolar electrodes, rather than the monopolar electrodes which are described herein. Those of skill in the art will know the variations in structure that will be made to accommodate bipolar, rather than monopolar electrodes, and therefore, these will not be described in detail. Of course, as is known in the art, pluralities of the individual cells will be employed in multi-cell units, often having common feed and product manifolds and being housed in unitary structures. Again, such constructions are known to those in the art and need not be discussed herein.

For most satisfactory and efficient operations the volume of the buffer compartment(s) will usually be from 1 to 100%, preferably from 5 to 70% that of the sum of the volumes of the anode and cathode compartments.

In a U.S. Environmental Protection Agency publication entitled Hypochlorite Generator for the Treatment of Combined Sewer Overflows (Water Pollution Control Research Series 11023 DAA 03/72) is described a method for electrolyzing brine solutions utilizing a three compartment cell having a membrane of the type described herein between the anode and buffer compartments but employing an ordinary diaphragm between the buffer and cathode compartments. Such a cell does not produce a chloride-free caustic when halide ion is in the buffer compartment and such caustic is needed for many applications. Additionally, the conventional diaphragms, which are usually of deposited asbestos fibers, tend to become blocked with insoluble impurities from the brine and have to be cleaned periodically, usually necessitating shutdown of the cell and often, replacement of the diaphragm.

The aqueous solution containing chloride ions is normally a water solution of sodium chloride, although potassium and other soluble chlorides, e.g., magnesium chloride and similar such salts, may be utilized, at least in part. However, it is preferable to employ the alkali metal chlorides and of these sodium chloride is the best. Sodium and potassium chlorides include cations which do not form insoluble salts or precipitates and which produce stable hydroxides. The concentration of sodium chloride in a brine charged will usually be as high as feasible, normally being from 200 to 320 grams per liter for sodium chloride and from 200 to 340 g./l. for potassium chloride, with intermediate figures for mixtures of sodium and potassium chlorides. The electrolyte may be neutral or acidified to a pH in the range of about 1 to 6, acidification normally being effected with a suitable acid such as hydrochloric acid. Charging of the brine is to the anolyte compartment, usually at a concentration of 200 to 320 g./l., most preferably of 250 to 300 g./l.

Although the dilute caustic made could be recirculated in the catholyte compartment such a recirculation might, if chloride has penetrated to the buffer compartment, add some chloride ion to the protected catholyte and therefore it is preferable that the dilute caustic not be allowed to "contaminate" the higher strength caustic. However, intracompartmental recirculations are often useful.

The presently preferred cation permselective membrane is of a hydrolyzed copolymer of perfluorinated hydrocarbon and a fluorosulfonated perfluorovinyl ether. The perfluorinated hydrocarbon is preferably tetrafluoroethylene, although other perfluorinated and saturated and unsaturated hydrocarbons of 2 to 5 carbon atoms may also be utilized, of which the monoolefinic hydrocarbons are preferred, especially those of 2 to 4 carbon atoms and most especially those of 2 to 3 carbon atoms, e.g., tetrafluoroethylene, hexafluoropropylene. The sulfonated perfluorovinyl ether which is most useful is that of the formula $FSO_2CF_2—CF_2OCF(CF_3)CF_2OCF=CF_2$. Such a material, named as perfluoro[2-(2-fluorosulfonylethoxy)-propyl vinyl ether], referred to henceforth as PSEPVE, may be modified to equivalent monomers, as by modifying the internal perfluorosulfonylethoxy component to the corresponding propoxy component and by altering the propyl to ethyl or butyl, plus rearranging positions of substitution of the sulfonyl thereon and utilizing isomers of the perfluoro-lower alkyl groups, respectively. However, it is most preferred to employ PSEPVE.

The method of manufacture of the hydrolyzed copolymer is described in Example XVII of U.S. Pat. No. 3,282,875 and an alternative method is mentioned in Canadian Pat. No. 849,670, which also discloses the use of the finished membrane in fuel cells, characterized therein as electrochemical cells. The disclosures of such patents are hereby incorporated herein by reference. In short, the copolymer may be made by reacting PSEPVE or equivalent with tetrafluoroethylene or equivalent in desired proportions in water at elevated temperature and pressure for over an hour, after which time the mix is cooled. It separates into a lower perfluoroether layer and an upper layer of aqueous medium with dispersed desired polymer. The molecular weight is indeterminate but the equivalent weight is about 900 to 1,600 preferably 1,100 to 1,400 and the percentage of PSEPVE or corresponding compound is about 10 to 30%, preferably 15 to 20% and most preferably about 17%. The unhydrolyzed copolymer may be compression molded at high temperature and pressure to produce sheets or membranes, which may vary in thickness from 0.02 to 0.5 mm. These are then further treated to hydrolyze pendant $—SO_2F$ groups to $—SO_3H$ groups, as by treating with 10% sulfuric acid or by the methods of the patents previously mentioned. The presence of the $—SO_3H$ groups may be verified by titration, as described in the Canadian patent. Additional details of various processing steps are described in Canadian Pat. No. 752,427 and U.S. Pat. No. 3,041,317, also hereby incorporated by reference.

Because it has been found that some expansion accompanies hydrolysis of the copolymer it is preferred to position the copolymer membrane after hydrolysis onto a frame or other support which will hold it in place in the electrolytic cell. Then it may be clamped or cemented in place and will be true, without sags. The membrane is preferably joined to the backing tetrafluoroethylene or other suitable filaments prior to hydrolysis, when it is still thermoplastic; and the film of copolymer covers each filament, penetrating into the spaces between them and even around behind them, thinning the films slightly in the process, where they cover the filaments.

The membrane described is far superior in the present processes to all other previously suggested membrane materials. It is more stable at elevated temperatures, e.g., above 75°C. It lasts for much longer time periods in the medium of the electrolyte and the caustic product and does not become brittle when subjected to chlorine at high cell temperatures. Considering the savings in time and fabrication costs, the present membranes are more economical. The voltage drop through the membranes is acceptable and does not become inordinately high, as it does with many other membrane materials, when the caustic concentration in the cathode compartment increases to above about 200 g./l. of caustic. The selectivity of the membrane and its compatibility with the electrolyte does not decrease detrimentally as the hydroxyl concentration in the catholyte liquor increases, as has been noted with other membrane materials. Furthermore, the caustic efficiency of the electrolysis does not diminish as significantly as it does with other membranes when the hydroxyl ion concentration in the catholyte increases. Thus, these differences in the present process make it practicable, whereas previously described processes have not attained commercial acceptance. While the more preferred copolymers are those having equivalent weights of 900 to 1,600, with 1,100 to 1,400 being most preferred, some useful resinous membranes produced by the present method may be of equivalent weights from 500 to 4,000. The medium equivalent weight polymers are preferred because they are of satisfactory strength and stability, enable better selective ion exchange to take place and are of lower internal resistances, all of which are important to the present electrochemical cell.

Improved versions of the above-described copolymers may be made by chemical treatment of surfaces thereof, as by treatments to modify the $—SO_3H$ group thereon. For example, the sulfonic group may be altered on the membrane to produce a concentration gradient or may be replaced in part with a phosphoric or phosphonic moiety. Such changes may be made in the manufacturing process or after production of the membrane. When effected as a subsequent surface treatment of a membrane the depth of treatment will usually be from 0.001 to 0.01 mm. Caustic efficiencies of the invented processes, using such modified versions of the present improved membranes can increase about 3 to 20%, often about 5 to 15%. Exemplary of such treatments is that described in French patent publication No. 2,152,194 of Mar. 26, 1973 in which one side of the membrane is treated with $NH_3$ to form $SO_2NH_2$ groups.

In addition to the copolymers previously discussed, including modifications thereof, it has been found that another type of membrane material is also superior to prior art films for applications in the present processes. Although it appears that tetrafluoroethylene (TFE) polymers which are sequentially styrenated and sulfonated are not useful for making satisfactory cation-active permselective membranes for use in the present electrolytic processes it has been established that perfluorinated ethylene propylene polymer (FEP) which is styrenated and sulfonated makes a useful membrane. Whereas useful lives of as much as three years or more (that of the preferred copolymers) may not be obtained the sulfostyrenated FEP's are surprisingly resistant to hardening and otherwise failing in use under the present process conditions.

To manufacture the sulfostyrenated FEP membranes a standard FEP, such as manufacture by E. I. DuPont de Nemours & Co., Inc., is styrenated and the styrenated polymer is then sulfonated. A solution of styrene in methylene chloride or benzene at a suitable concentration in the range of about 10 to 20% is prepared and a sheet of FEP polymer having a thickness of about 0.02 to 0.5 mm., preferably 0.05 to 0.15 mm., is dipped into the solution. After removal it is subjected to radiation treatment, using a cobalt$^{60}$ radiation source. The rate of application may be in the range of about 8,000 rads/hr. and a total radiation application is about 0.9 megarads. After rinsing with water the phenyl rings of the styrene portion of the polymer are monosulfonated, preferably in the para position, by treatment with chlorosulfonic acid, fuming sulfuric acid or $SO_3$. Preferably, chlorosulfonic acid in chloroform is utilized and the sulfonation is completed in about ½ hour.

Examples of useful membranes made by the described process are products of RAI Research Corporation, Hauppauge, New York, identified as 18ST12S and 16ST13S, the former being 18% styrenated and having ⅔ of the phenyl groups monosulfonated and the latter being 16% styrenated and having 13/16 of the phenyl groups monosulfonated. To obtain 18% styrenation a solution of 17½% of styrene in methylene chloride is utilized and to obtain the 16% styrenation a solution of 16% of styrene in methylene chloride is employed.

The products resulting compare favorably with the preferred copolymers previously described, giving voltage drops of about 0.2 volt each in the present cells at a current density of 2 amperes/sq. in., the same as is obtained from the copolymer.

The membrane walls will normally be from 0.02 to 0.5 mm. thick, preferably from 0.1 to 0.5 mm. and most preferably 0.1 to 0.3 mm. When mounted on a polytetrafluoroethylene, asbestos, titanium or other suitable network, for support, the network filaments or fibers will usually have a thickness of 0.01 to 0.5 mm., preferably 0.05 to 0.15 mm., corresponding to up to the thickness of the membrane. Often it will be preferable for the fibers to be less than half the film thickness but filament thicknesses greater than that of the film may also be successfully employed, e.g., compartment(s) to 5 times the film thickness. The networks, screens or cloths have an area percentage of openings therein from about 8 to 80%, preferably 10 to 70% and most preferably 30 to 70%. Generally the cross sections of the filaments will be circular but other shapes, such as ellipses, squares and rectangles, are also useful. The supporting network is preferably a screen or cloth and although it may be cemented to the membrane it is preferred that it be fused to it by high temperature, high pressure compression before hydrolysis of the copolymer. Then, the membrane-network composite can be clamped or otherwise fastened in place in a holder or support. It is preferred to employ the described backed membranes as walls of the cell between the anolyte and catholyte compartments and the buffer commpartment(s) but if desired, that separating the anolyte and buffer compartments may be of conventional diaphragm material, e.g., deposited asbestos fibers or synthetic polymeric fibrous material (polytetrafluoroethylene, polypropylene). Also, treated asbestos fibers may be utilized and such fibers mixed with synthetic organic polymeric fibers may be employed. However, when such diaphragms are used efforts should be made to remove hardness ions and other impurities from the feed to the cell so as to prevent these from prematurely depositing on and blocking the diaphragms.

The material of construction of the cell body may be conventional, including concrete or stressed concrete lined with mastics, rubbers, e.g., neoprene, polyvinylidene chloride, FEP, chlorendic acid based polyester, polypropylene, polyvinyl chloride, TFE or other suitable plastic or may be similarly lined boxes of other structural materials. Substantially self-supporting structures, such as rigid polyvinyl chloride polyvinylidene chloride, polypropylene or phenol formaldehyde resins may be employed, preferably reinforced with molded-in fibers, cloths or webs.

The electrodes of the cell can be made of any electrically conductive material which will resist the attack of the various cell contents. In general, the cathodes are made of graphite, iron, lead dioxide on graphite or titanium, steel or noble metal, such as platinum, iridium, ruthenium or rhodium. Of course, when using the noble metals, they may be deposited as surfaces on conductive substrates, e.g., copper, silver, aluminum, steel, iron. The anodes are also of materials or have surfaces of materials such as noble metals, noble metal alloys, noble metal oxides, noble metal oxides mixed with valve metal oxides, e.g., ruthenium oxide plus titanium dioxide, or mixtures thereof, on a substrate which is conductive. Preferably, such surfaces are on or with a valve metal and connect to a conductive metal, such as those previously described. Especially useful are platinum, platinum on titanium, platinum oxide on titanium, mixtures of ruthenium and platinum and their oxides on titanium and similar surfaces on other valve metals, e.g., tantalum. The conductors for such materials may be aluminum, copper, silver, steel or iron, with copper being much preferred. A preferable dimensionally stable anode is ruthenium oxidetitanium dioxide mixture on a titanium substrate, connected to a copper conductor.

The voltage drop from anode to cathode is usually in the range of about 2.3 to 5 volts, although sometimes it is slightly more than 5 volts, e.g., up to 6 volts. Preferably, it is in the range of 3.5 to 4.5 volts. The current density, while it may be from 0.5 to 4 amperes per square inch of electrode surface, is preferably from 1 to 3 amperes/sq. in. and ideally about 2 amperes/sq. in. The voltage ranges given are for perfectly aligned electrodes and it is understood that where such alignment is not exact, as in laboratory units, the voltages can be up to about 0.5 volt higher.

The various advantages obtainable by practice of the present invention have been mentioned previously but will be discussed in part and in additional detail herein. The improved current efficiency is due in large part to the use of a more dilute caustic in the buffer compartment so that the pressure on the caustic ions to penetrate into the anode compartment is not as great. Such pressure can be further diminished by feeding additional water to the buffer compartment and making a weaker caustic, e.g., one of 25 to 50 g./l. concentration.

It is desirable that the anolyte be acid so as to react with any hydroxyl entering it from the buffer zone, preventing oxygen formation. While pH ranges of 1 to 6 can be used, 1 to 5 is preferred, and 2 to 4 is best. Buffer solution and catholyte pH's are 14. The temperature of the electrolyte (in all compartments) will be maintained at less than 105° C., preferably being 20° to 95°C., more preferably 50° to 95°C. and most preferably about 65° to 95°C. Electrolyte temperatures may be controlled by recirculation of portions thereof and by regulations of proportions of feeds to the various zones and the temperatures thereof. Of course, when temperatures cannot be lowered sufficiently by recirculation or feed control, refrigeration or other cooling means or liquids may also be employed. For example, the feed of diluting water to the buffer compartment, possible feeds of dilute caustic to the catholyte compartment and recirculating anolyte employed may be cooled to about 10° to 20°C., preferably about 10°C., before admission to the compartment or may be cooled merely by exposure to ambient conditions before entering the cell.

The greatly improved current efficiencies mentioned may be from 90 to 97% chlorine current efficiency and over 80%, often over 85% caustic current efficiency. It has been found that caustic efficiency (Faradaic) decreases as caustic concentration of the buffer effluent increases, being essentially a straight line function of concentration from 90% at 73 g.p.l. to 82% at 150 g.p.l., then dropping off more sharply to 72% at 180 g.p.l.

The high concentration caustic solution made is free of chloride, normally containing as little as 0.1 to 10 g./l. thereof, with the caustic concentration being from 250 to 400 g./l. and that of the dilute caustic being from 60 or 100 to 200 g./l. The sodium hydroxide concentration from the catholyte can be increased by feeding dilute sodium hydroxide to it, recirculating sodium hydroxide solution previously taken off, increasing the electrolysis time or diminishing the rate of caustic removal. Alternatively, as was previously mentioned, more concentrated caustic solutions may be made by evaporation and because the caustic is fairly well concentrated to begin with, comparatively little thermal energy is needed to raise it to 50%.

The present cells may be incorporated in large or small plants, thus producing usable caustic while making from 20 to 1,000 tons per day of chlorine or equivalent and in all cases efficiencies obtained can be such as to make the process economically desirable. It is highly preferred however that the installation should be located near to and be used in conjunction with a pulp bleaching plant so that the hypochlorite or chlorate solid or solution may be made from the dilute caustic and then may be employed as a bleach or in the production of bleaching agent, e.g., chlorine dioxide. There are also several other uses for dilute caustic in pulping and bleaching plants.

The following examples illustrate but do not limit the invention. Unless otherwise indicated, all parts are by weight and all temperatures are in °C.

EXAMPLE 1

A three-compartment electrolytic cell, as illustrated in the FIGURE but with changes described herein, is utilized to produce chlorine, hydrogen and dilute and more concentrated caustic solutions from an aqueous sodium chloride solution. The electrolytic cells have polyester (Hetron) walls for the anolyte compartment and steel walls for the catholyte compartment but in other experiments polypropylene or steel lined with unplasticized polyvinyl chloride are substituted, with equivalent results. All parts or sections may be joined together, using rubber gaskets between them. The electrodes are adjacent to the membranes separating the buffer compartment from the electrode compartments and such membranes are cation-active permselective membranes manufactured by E. I. DuPont de Nemours & Company, Inc. and sold as their XR-type membranes. The membranes are 7 mils thick, (about 0.2 mm.) and are joined to a backing or supporting network of polytetrafluoroethylene (Teflon) filaments of a diameter of about 0.1 mm., woven into a cloth which has an area percentage of openings therein of about 22%. They were initially flat and were fused onto the screen or cloth of Teflon by high temperature, high compression pressing, with some of the membrane portions actually flowing around the filaments during a fusion process to lock onto the cloth, without thickening the membrane between the cloth filaments.

The material of the XR-type permselective membrane is a hydrolyzed copolymer of a perfluorinated hydrocarbon and a fluorosulfonated perfluorovinyl ether. The copolymer is of tetrafluoroethylene and $FSO_2CF_2CF_2OCF(CF_3)CF_2OCF{=}CF_2$ and has an equivalent weight in the 900 to 1,600 range, about 1,250. The electrodes are in contact with the buffer membranes, with the "flatter" sides of the membranes facing the contacting electrodes. In some experiments spacings of 0.01 to 5 mm. between the electrodes and the membranes are utilized and satisfactory results are obtained but the present arrangement, and the absence of spacings is preferred.

In the experimental apparatus a single anode and a single cathode are used, each being two inches wide and thirty inches high. The anode is of ruthenium oxide on titanium and the cathode is of steel. The titanium base for the anode is titanium mesh, 1 mm. in diameter and with about 50% open area, coated with ruthenium oxide 1 mm. thick. In other experiments the anode is of the same base titanium mesh but has a mixture of ruthenium oxide and titanium oxide applied thereto, with the ratio of ruthenium oxide to titanium oxide being about 1:3, by weight. The titanium mesh is communicated with a positive direct current electrical source through a titanium-clad copper conductor rod. The cathode is of mild steel wire mesh, essentially 1 mm. in equivalent diameter, having about 35% open area, and is communicated with a negative electrical source or a sink by a copper conductor.

The interelectrode distance and the width of the buffer compartment are about 6 mm. and the ratio of anode compartment : buffer compartment : cathode compartment volumes is about 10:1:10.

The anode compartment is filled with a saturated salt solution or brine, preferably sodium chloride at about a 25% concentration, and the cathode and buffer compartments are filled with water, initially containing a small quantity of salt or brine to improve conductivity. The current is turned on and chlorine and hydrogen produced are taken off. Water is fed to the buffer compartment to maintain the concentration of sodium hydroxide therein low and at the desired concentrations, dilute and more concentrated sodium hydroxide solutions are removed from the buffer compartment and the cathode compartment, respectively. That from the buffer compartment is reacted with some of the chlorine produced to make sodium hypochlorite and this is subsequently converted to sodium chlorate, by pH regulation by addition of more chlorine. The chlorate is separated from chloride contained in the solution by conventional crystallizing apparatus and solid sodium chloride and sodium chlorate crystals result.

In a continuous process, utilizing the apparatus described, the high concentration sodium hydroxide solution withdrawn from the catholyte contains 325 g./l. of sodium hydroxide and the buffer solution concentration of the hydroxide contains 120 g./l. thereof, with the caustic current efficiency being calculated to be 86%. Half of the caustic made is in the weak liquor, (from the buffer compartment) and the other half is made as a stronger liquor (catholyte). Volume ratio of the liquors is 5:1. Approximately equal weights of chlorine and sodium hydroxide are produced by the cell. Chlorine efficiency is found to be 95.5%. The voltage drop is 4.15 volts and the current density is 2 amperes per square inch.

The strong caustic solution made is evaporated to 50% caustic, a standard concentration for concentrated caustic solution, and the dilute caustic is reacted with chlorine produced to form hypochlorite at a pH of about 10, which is then converted by additional chlorine treatment to chlorate at a pH of 6.5. The chlorate is separated from contained chloride by crystallization. Alternatively, in some experiments, the hypochlorite is employed directly as a bleaching means, although because of its instability it is consumed quickly. In other experiments the chlorate is made directly, without initial separation of hypochlorite and in still other experiments the chlorate is not crystallized out as a solid but is utilized, with and without chloride, usually with the chloride removed, as a bleaching agent for groundwood pulp.

In a larger scale operation, utilizing a cell with a plurality of electrodes of the type mentioned and rated at 150 kiloamperes, 5.01 tons per day of chlorine and 4.85 tons per day of caustic are produced at a caustic efficiency of 86% and a chlorine efficiency of 95.5%, with a 4.15 volts drop across the electrodes and a current density of two amperes/sq. in. As in the laboratory experiment described, half of the caustic is produced as weak liquor and half as strong liquor, with the ratio of weak to strong liquor being about 5:1. The weak liquor contains 120 g./l. of sodium hydroxide and the strong liquor contains 325 g./l. of sodium hydroxide. The cell walls are made of molded asbestos filled polypropylene.

In modification of the large scale operations, the thickness of the membrane is increased to 10 and 14 mils, at which caustic efficiencies increase but voltage drops also increase. Accordingly, although the membranes of greater thicknesses are operative, it is preferred to employ the 7 mil membranes in these reactions. Membranes which are 4 mils thick are also used and are satisfactory, although caustic efficiency is decreased slightly.

EXAMPLE 2

The laboratory experiment of Example 1 is repeated, utilizing ten mil membranes of membrane materials identified as 18ST12S and 16ST13S, respectively, made by RAI Research Corporation, in replacement of the hydrolyzed copolymer of tetrafluoroethylene and sulfonated perfluorovinyl ether. The former of the RAI products is a sulfostyrenated FED in which the FED is 18% styrenated and has ⅔ of the phenyl groups thereof monosulfonated, and the latter is 16% styrenated and has 13/16 of the phenyl groups monosulfonated. The membranes stand up better than other cation-active permselective membranes on the market, except for the XR-type membranes described, and are especially useful in cathode compartment applications under usual operating conditions. In such uses they are significantly better in appearance and operating characteristics, e.g., physical appearance, uniformity, voltage drop, than other cation-active permselective membrane materials available (except the hydrolyzed copolymers of perfluorinated hydrocarbons and fluorosulfonated perfluorovinyl ethers). Similarly, when the RAI Research Corporation membranes 18ST12S and 16ST13S are substituted in the large scale operation of Example 1 and no other changes are made in the process conditions, they function in the same manner, being superior to other cation-active permselective membranes but apparently not having as long a useful life as the described hydrolyzed copolymers of perfluorinated hydrocarbons and fluorosulfonated perfluorovinyl ethers. Work is now being undertaken to extend such useful operating life. Essentially the same operating characteristics are obtained under the conditions described when the RAI membranes are employed instead of the XR-type membranes of Example 1, so long as the voltage drop does not increase to an unacceptable extent.

In variations of this example the operating temperature is changed from the 95°C. used in Examples 1 and 2 supra, to 80°C. Although efficiencies diminish somewhat the reactions are satisfactorily operative at such temperatures, too. In other variations of the laboratory scale experiment the surface of the cathode is changed to platinum or graphite and the surface of the anode is also changed to platinum or titanium oxide-ruthenium oxide 3:1 mixture (on titanium) and essentially the same results are obtained.

In the described experiments of this example the more concentrated caustic solution produced is piped to an evaporator for further concentration to 50% caustic solution and the dilute hydroxide solution is employed directly for pulping of wood chips. Alternatively, the dilute solution is used to make hypochlorite, to manufacture chlorate, to neutralize acid, to dilute more concentrated caustic and to be evaporated to a more concentrated caustic. Of these uses, it is preferred to employ it directly for pulping wood chips, producing hypochlorite, manufacturing chlorate and neutralizing acid, all of which operations are effected in connection with the operation of a groundwood pulp bleaching plant.

EXAMPLE 3

A laboratory procedure of Example 1 is repeated with the exception that instead of the anode-side cation-active permselective membrane there is employed a standard diaphragm cell asbestos diaphragm. The diaphragm allows some hydroxide to migrate from the buffer zone to the anolyte where it is converted in part to oxygen, thereby diminishing caustic efficiency about 5%. Also, some chloride from the anode compartment passes through the diaphragm to the buffer zone, raising the chloride content of the buffer solution to about 10% of that of the hydroxide, by weight. In the long run, cost savings made by utilizing the permeable asbestos diaphragm are more than compensated for by increased expenses due to lower caustic efficiency and the lower value of chloride containing dilute caustic. The concentration of chloride in the strong liquor from the cathode compartment is not appreciably increased.

When the above continuous process and the other previously described continuous laboratory processes are carried out as batch operations they are effective in producing the same products but efficiencies are appreciably diminished and more operator and supervisory time are required. Accordingly, the continuous processes are much preferred.

EXAMPLE 4

The procedure of the laboratory experiment of Example 1 is repeated, with recycling of anolyte through a resaturator and back to the anode compartment. The recycling maintains a constant composition in the anode compartment, helping to avoid polarization therein. The resaturator is operated at 25% saturation, employing solid sodium chloride, obtained by crystallization from the common solution with $NaClO_3$ during the production of solid $NaClO_3$. The anolyte removed from the anode compartment has a sodium chloride concentration of about 22% and the recirculation rate allows for a change of the electrolyte every 30 seconds. To obtain the desired agitation in the compartment some of the recirculating anolyte, e.g., 50%, is allowed to bypass the resaturator.

EXAMPLE 5

The commercial size cell of Example 1 is operated at a 95.5% chlorine efficiency and a caustic efficiency of 90%, utilizing a current density of 2 a.s.i. and a cell voltage of 4.25 volts. 5.01 Tons per day of chlorine and 5.06 tons per day of caustic are produced, with a total of 2.78 tons of the caustic being in the strong liquor, which is at a concentration of 270 g./l. sodium hydroxide, and 2.28 tons per day being in the weak liquor from the buffer compartment, which is at a concentration of 80 g./l. NaOH. The volume ratio of strong liquor to weak liquor is about 1:2.5. When the membrane is replaced with a modified form thereof, which is surface treated by the manufacturer, increased efficiency (about a 5% improvement) is obtained.

EXAMPLE 6

The procedure of Example 1 is repeated, again with the commercial size cell described therein, operating at a chlorine efficiency of 95.5% and a caustic efficiency of 83%. The operating conditions are 2 amperes/sq. in. and 4.05 volts, producing one part of strong liquor and 5 parts of weak liquor, the strong liquor being at 340 g./l. NaOH concentration and the weak (buffer) liquor being at 140 g./l. NaOH concentration. The cell produces 5.01 tons per day of chlorine and 4.68 tons per day of caustic, with the caustic production being evenly divided between weak and strong liquor. In this and the other described experiments anolyte pH is held at about 3.5 by chlorine generation and HCl addition. When HCl is not added and the pH is in the 5–7 range decreased efficiency results but the present process of this example and those of the other examples are operative, although less desirable.

The invention has been described with respect to working examples and illustrative embodiments but is not to be limited to these because it is evident that one of ordinary skill in the art will be able to utilize substitutes and equivalents without departing from the spirit of the invention or the scope of the claims.

What is claimed is:

1. A method for simultaneously producing a dilute aqueous solution of an alkali metal hydroxide and a more concentrated aqueous solution of an alkali metal hydroxide which comprises subjecting an aqueous solution containing 200 to 340 g./l. of an alkali metal halide to electrolysis in an electrolytic cell having at least three compartments therein; said compartments comprise an anode compartment to which the alkali metal halide solution is added, a cathode compartment, and at least one buffer compartment whereby at least two cation-active permselective membranes of a hydrolyzed copolymer of a perfluorinated hydrocarbon and a fluorosulfonated perfluorovinyl ether, or a sulfostyrenated perfluorinated ethylene propylene polymer, define an anode sidewall and a cathode sidewall of said buffer compartment, said buffer compartment is positioned between said anode compartment and said cathode compartment, and whereby said anode sidewall and said cathode sidewalls of said buffer compartment, with other sidewalls thereabout, define said anode compartment and said cathode compartment; adding water to the buffer compartment in such an amount to be thereby producing and withdrawing a dilute aqueous solution, substantially free of halide ions, containing 60 to 200 g./l. of an alkali metal hydroxide from the buffer compartment while simultaneously producing and withdrawing a more concentrated aqueous solution, substantially free of halide ions, containing 250 to 450 g./l. of an alkali metal hydroxide from the cathode compartment, and maintaining a high caustic current efficiency of 80% or more during the electrolysis.

2. A method according to claim 1 wherein the aqueous solution containing halide ions is a solution of sodium chloride, the hydroxide produced is sodium hydroxide, the permselective membranes are of a hydrolyzed copolymer of tetrafluoroethylene and a fluorosulfonated perfluorovinyl ether of the formula $FSO_2CF_2CF_2OCF(CF_3)CF_2OCF{=}CF_2$, which copolymer has an equivalent weight of about 900 to 1,600, the concentrated hydroxide solution contains over 250 grams per liter of sodium hydroxide and the dilute sodium hydroxide solution contains over 60 g./l. thereof.

3. A method according to claim 2 wherein the electrolytic cell contains three compartments, chlorine is removed from the anode compartment, hydrogen is removed from the cathode compartment, dilute sodium hydroxide of a concentration of 60 to 200 g./l. sodium hydroxide is removed from the buffer compartment and more concentrated sodium hydroxide solution of a concentration of 250 to 450 g./l. is removed from the cathode compartment, the permselective membranes are about 0.02 to 0.5 mm. thick, the concentration of sodium chloride in the anode compartment is from about 200 to 320 g./l., the pH of the anolyte is about 1 to 5, the temperatures of anolyte, catholyte and buffer compartment solutions are less than 105°C. and the caustic current efficiency is above 80%.

4. A method according to claim 3 wherein the permselective membranes are mounted on a network of material selected from the group consisting of polytetrafluoroethylene, asbestos, perfluorinated ethylene propylene polymer, polypropylene, titanium, tantalum, niobium and noble metals and which has an area percentage of openings therein from about 8 to 80%, the temperatures of the anolyte, catholyte and buffer compartment solutions are in the range of 20° to 95°C., the surface of the cathode is of a material selected from the group consisting of platinum, iridium, ruthenium, rhodium, graphite, iron and steel and the surface of the anode is of a material selected from the group consisting of noble metals, noble metal alloys, noble metal oxides, mixtures of noble metal oxides with valve metal oxides, or mixtures thereof, on a valve metal, the voltage is from about 2.3 to 6 volts, the current density is from about 0.5 to 4 amperes per square inch of electrode surface, and the dilute caustic solution produced is piped to and consumed in a chemical operation selected from the group consisting of pulping operations, production of hypochlorite, manufacture of chlorate and neutralization of acid, or is concentrated by evaporation.

5. A method according to claim 4 wherein the network is a screen or cloth of polytetrafluoroethylene filaments having a thickness of 0.01 to 0.3 mm., the membrane walls are from 0.1 to 0.3 mm. thick, the polytetrafluoroethylene filament thickness is less than or equal to that of the membrane walls, the copolymer equivalent weight is from about 1,100 to 1,400, the cathode is of steel and the anode is of ruthenium oxide on titanium, the aqueous sodium chloride solution electrolyte is at a concentration of about 250 to 300 grams per liter, the pH of the anolyte is from 2 to 4, the temperatures of the anolyte, catholyte and buffer compartment solutions are from about 65° to 95°C., water is added to the buffer compartment at such a rate and the caustic takeoffs are so controlled as to produce about 40 to 60% of the caustic at the higher concentration and 60 to 40% at the lower concentration and the more concentrated caustic produced is piped to an evaporator for further concentration.

6. A method according to claim 5 wherein the dilute caustic made is at a concentration of about 120 g./l., the more concentrated caustic made is at a concentration of about 300 g./l., the addition of water to the buffer compartment is at such a rate and the caustic takeoffs are so controlled as to produce about 50% of the caustic simultaneously at each of the higher and lower concentrations and the concentrated caustic is evaporated to produce a 50% caustic.

7. A method according to claim 6 wherein, after removal from the cell, the dilute hydroxide solution is employed directly for pulping wood chips, producing hypochlorite, manufacturing chlorate or neutralization of acid.

8. A method according to claim 1 wherein, after removal from the cell, the dilute hydroxide solution is employed directly for pulping wood chips, producing hypochlorite, manufacturing chlorate or neutralization of acid or is used to dilute more concentrated caustic or is evaporated to a more concentrated caustic.

* * * * *